US008763589B2

(12) United States Patent
Lim et al.

(10) Patent No.: US 8,763,589 B2
(45) Date of Patent: Jul. 1, 2014

(54) FUEL PUMP MODULE

(75) Inventors: JongKeun Lim, Cheongju-si (KR); Inseok Sohn, Cheongju-si (KR); Kyuseob Shin, Daejeon (KR); Joonseup Kim, Daejeon (KR); Munsik Jeon, Cheongju-si (KR)

(73) Assignee: COAVIS, Chungcheongnam-do (KR)

( * ) Notice: Subject to any disclaimer, the term of this patent is extended or adjusted under 35 U.S.C. 154(b) by 800 days.

(21) Appl. No.: 13/006,971

(22) Filed: Jan. 14, 2011

(65) Prior Publication Data

US 2011/0174274 A1 Jul. 21, 2011

(30) Foreign Application Priority Data

Jan. 15, 2010 (KR) ..... 10-2010-0003759

(51) Int. Cl.
*F02M 37/08* (2006.01)
*F02M 37/10* (2006.01)
*F02M 37/22* (2006.01)

(52) U.S. Cl.
CPC ..... *F02M 37/106* (2013.01); *F02M 37/10* (2013.01); *F02M 37/22* (2013.01); *F02M 37/25* (2013.01)
USPC ..... 123/509; 123/495; 123/497; 123/511

(58) Field of Classification Search
CPC ..... F02M 37/10; F02M 37/106; F02M 2037/225; F02M 2037/228; F02M 37/22; F02M 37/025; B01D 29/11; B01D 35/027; B01D 37/0273; B01D 37/0276; B01D 29/15; B01D 29/19; B01D 2201/04; B01D 2201/0415; B60K 2015/03105; B60K 2015/03236; B60K 2015/0325
USPC ..... 123/495, 497, 509, 510, 511, 514
See application file for complete search history.

(56) References Cited

U.S. PATENT DOCUMENTS

| | | | | |
|---|---|---|---|---|
| 5,146,901 | A * | 9/1992 | Jones | 123/516 |
| 5,392,750 | A * | 2/1995 | Laue et al. | 123/509 |
| 5,647,330 | A * | 7/1997 | Sawert et al. | 123/509 |
| 5,785,084 | A * | 7/1998 | Richter et al. | 137/549 |
| 6,029,633 | A * | 2/2000 | Brandt | 123/509 |
| 6,196,200 | B1 * | 3/2001 | Roche | 123/509 |
| 6,746,603 | B2 * | 6/2004 | Harvey et al. | 210/234 |
| 6,955,158 | B2 * | 10/2005 | Rumpf | 123/514 |
| 6,966,306 | B2 * | 11/2005 | Sawert et al. | 123/509 |
| 7,117,854 | B2 * | 10/2006 | Schmitt | 123/509 |
| 7,156,077 | B2 * | 1/2007 | Koller et al. | 123/467 |
| 7,198,035 | B2 * | 4/2007 | Kadler et al. | 123/509 |
| 7,207,320 | B2 * | 4/2007 | Ikeya | 123/509 |
| 7,757,672 | B2 * | 7/2010 | Villaire et al. | 123/509 |

(Continued)

*Primary Examiner* — Hai Huynh
*Assistant Examiner* — Raza Najmuddin
(74) *Attorney, Agent, or Firm* — The Webb Law Firm

(57) ABSTRACT

A fuel pump module including: a reservoir installed in a fuel tank, the reservoir being charged with a predetermined amount of fuel; a fuel pump installed in the reservoir and pumping the fuel contained in the reservoir to an internal combustion engine; a jet pump injecting a fuel jet into the reservoir to thereby introduce the fuel stored in the fuel tank into the reservoir; a guide tube installed on the jet pump and guiding both the fuel jet and the fuel introduced from the fuel tank along with the fuel jet into the reservoir; and a filter unit partitioning the interior of the reservoir into a fuel suction area, into which the fuel is introduced by the fuel pump, and a fuel charging area, which is charged with the fuel from the fuel tank, thus preventing foreign substances from being introduced from the fuel charging area into the fuel suction area.

9 Claims, 5 Drawing Sheets

(56) References Cited

U.S. PATENT DOCUMENTS

| | | | | |
|---|---|---|---|---|
| 2002/0152996 | A1* | 10/2002 | Gabauer et al. | 123/509 |
| 2004/0050371 | A1* | 3/2004 | Baz | 123/509 |
| 2005/0045159 | A1* | 3/2005 | Honda et al. | 123/509 |
| 2005/0051141 | A1* | 3/2005 | Rumpf | 123/514 |
| 2005/0121003 | A1* | 6/2005 | Sawert et al. | 123/509 |
| 2005/0133430 | A1* | 6/2005 | de Savasse et al. | 210/234 |
| 2006/0011172 | A1* | 1/2006 | Kadler et al. | 123/509 |
| 2006/0048756 | A1* | 3/2006 | Ikeya | 123/509 |
| 2006/0249124 | A1* | 11/2006 | Schmitt | 123/509 |
| 2009/0064973 | A1* | 3/2009 | Dickenscheid | 123/506 |
| 2013/0000608 | A1* | 1/2013 | Kwon et al. | 123/495 |
| 2013/0098339 | A1* | 4/2013 | Yoon et al. | 123/495 |

* cited by examiner

FUEL PUMP MODULE

BACKGROUND OF THE INVENTION

1. Field of the Invention

The present invention relates, in general, to a fuel pump module installed in a fuel tank and controlling the supply of fuel from the fuel tank to an internal combustion engine and, more particularly, to a fuel pump module, which partitions the interior of a reservoir into a fuel charging area B for charging the reservoir with the fuel flowing from a fuel tank, and a fuel suction area A for sucking the fuel from the fuel charging area B using a fuel pump, thus preventing foreign substances from being introduced from the fuel charging area B into the fuel suction area A thereby supplying clean fuel to the internal combustion engine.

2. Description of the Related Art

Although when a vehicle using liquid fuel, such as gasoline or diesel, is at a tilt at the angle of the road and thereby fuel filled in a fuel tank leans to one side or when the vehicle is low on fuel so that there is an insufficient amount of fuel in the fuel tank, a predetermined amount of fuel must be supplied to an internal combustion engine at a constant rate. In an effort to achieve this function, a fuel pump module is installed in the fuel tank.

FIGS. 1 and 2 are views illustrating examples of conventional fuel pump modules. FIG. 1 illustrates a fuel pump module, which injects fuel returning from an internal combustion engine into a reservoir so that the fuel stored in the fuel tank can be charged into the reservoir by the fuel jet functioning as an actuating fluid. FIG. 2 illustrates another type of fuel pump module, which directly injects the fuel pumped by a fuel pump into the reservoir so that the fuel stored in the fuel tank can be charged into the reservoir by the fuel jet functioning as an actuating fluid.

As shown in FIGS. 1 and 2, the fuel pump module 110 includes a reservoir 120 that has a container shape and is charged with a predetermined amount of fuel, a fuel pump 140 installed in the reservoir 120 that pumps the fuel from the reservoir 120 into an internal combustion engine 170 at a constant rate, a jet pump 150 for injecting the fuel into the reservoir 120 so that the fuel stored in a fuel tank 100 can be guided into the reservoir 120 by the fuel jet injected by the jet pump 150, and a guide tube 160 installed on the jet pump 150 which allows the fuel introduced into the reservoir 120 by the jet pump 150 to be charged into the reservoir 120.

In the fuel pump module 110, the jet pump 150 injects the fuel into the reservoir 120 which allows the fuel stored in the fuel tank 100 to be introduced into the reservoir 120. Here, the jet pump 150 may inject the fuel returning from the internal combustion engine 170 in the reservoir 120, as shown in FIG. 1, or may pump the fuel stored in the fuel tank 100 and injects the fuel into the reservoir 120, as shown in FIG. 2.

Because the fuel is injected into the reservoir 120 at a high injection speed by the jet pump 150, the flow velocity around the jet pump 150 increases, but pressure around the pump 150 is reduced, so that the fuel stored in the fuel tank 100 is naturally introduced to the jet pump 150 and the fuel introduced to the jet pump 150 in the above state is guided into the reservoir 120.

The fuel introduced into the reservoir 120 by the jet pump 150 flows along the guide tube 160 installed on the jet pump 150 up to the height of the guide tube 160, and is charged into the reservoir 120.

The fuel is charged into the reservoir 120 by the above-mentioned process and is supplied to the internal combustion engine 170 by the fuel pump 140 at a constant rate.

However, because the fuel pump module 110 is installed at a location close to the bottom of the fuel tank 100, foreign substances 190 present in the fuel tank 100 may be introduced into the reservoir 120 along the fuel during the process of introducing the fuel from the fuel tank 100 into the reservoir 120.

The foreign substances introduced into the reservoir 120 cannot be discharged from the fuel pump module 110 due to the structure of the fuel pump module 110, but collect over time in the reservoir 120, and perturb the fuel suction and fuel supply operation of the fuel pump 140, thereby reducing the performance of the fuel pump module 110 including the fuel pump 140.

Due to the foreign substances, there may not be a constant supply of fuel to the internal combustion engine 170, thus reducing the fuel consumption ratio and causing operational problems in the internal combustion engine 170. Further, the foreign substances may cause the internal combustion engine to suddenly stop while the vehicle runs, and may cause the vehicle to be in a serious traffic accident.

SUMMARY OF THE INVENTION

Accordingly, the present invention has been made keeping in mind the above problems occurring in the related art, and the present invention is intended to propose a fuel pump module, which can prevent foreign substances from being introduced from a fuel charging area for charging the interior of a reservoir with fuel into a fuel suction area for sucking the fuel using a fuel pump, thus supplying clean fuel to an internal combustion engine.

Further, the present invention is intended to propose a fuel pump module, which can supply clean fuel to the internal combustion engine, thus preventing operational problems from occurring in the internal combustion engine and increasing the fuel consumption ratio.

In order to achieve the above object, according to one aspect of the present invention, there is provided a fuel pump module comprising: a reservoir installed in a fuel tank of a vehicle and having a bowl shape charged with a predetermined amount of fuel; a fuel pump installed in the reservoir and pumping the fuel contained in the reservoir to an internal combustion engine; a jet pump injecting a fuel jet into the reservoir and thereby introducing the fuel stored in the fuel tank into the reservoir; a guide tube installed on the jet pump and extending upwards a predetermined distance, the guide tube guiding both the fuel jet injected by the jet pump and the fuel introduced from the fuel tank along with the fuel jet such that both the fuel jet and the fuel can be charged in the reservoir; and a filter unit partitioning an interior of the reservoir into a fuel suction area, into which the fuel is introduced by the fuel pump, and a fuel charging area, which is charged with the fuel from the fuel tank, the filter unit thus preventing foreign substances from being introduced from the fuel charging area into the fuel suction area.

The filter unit may be integrated with the reservoir.

Further, the filter unit may be detachably installed in the reservoir.

Further, the reservoir may be provided with a guide groove on an inner surface thereof, and the filter unit may be installed in the reservoir using the guide groove.

Further, the filter unit may be provided with a cutoff wall at a lower end thereof.

Further, the cutoff wall may integrally protrude from the reservoir.

Further, the cutoff wall may be integrated with the lower end of the filter unit.

Further, the fuel charging area may be provided with a foreign substance collector on a bottom thereof.

Further, the filter unit may comprise mesh.

Further, a mesh size of the mesh of the filter unit may be 55~60 microns.

As described above, the present invention is advantageous in that it can prevent foreign substances from being introduced into the fuel suction area, into which the fuel is introduced by the fuel pump, thus protecting the fuel pump from the damage that the foreign substances can cause and preventing the performance of the fuel pump from dropping, thereby improving the durability of the fuel pump module including the fuel pump.

Further, the present invention can supply clean fuel to the internal combustion engine, thus protecting the internal combustion engine from the foreign substances and increasing the fuel consumption ratio.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Reference will now be made in greater detail to the preferred embodiments of the present invention, examples of which are illustrated in the accompanying drawings.

In the following description, a detailed description of those elements, which remain the same as in the related art and for which it is not felt that a further explanation is required, will be omitted. However, those skilled in the art will appreciate that the scope and spirit of the invention are not limited by the omissions.

Figure 1:
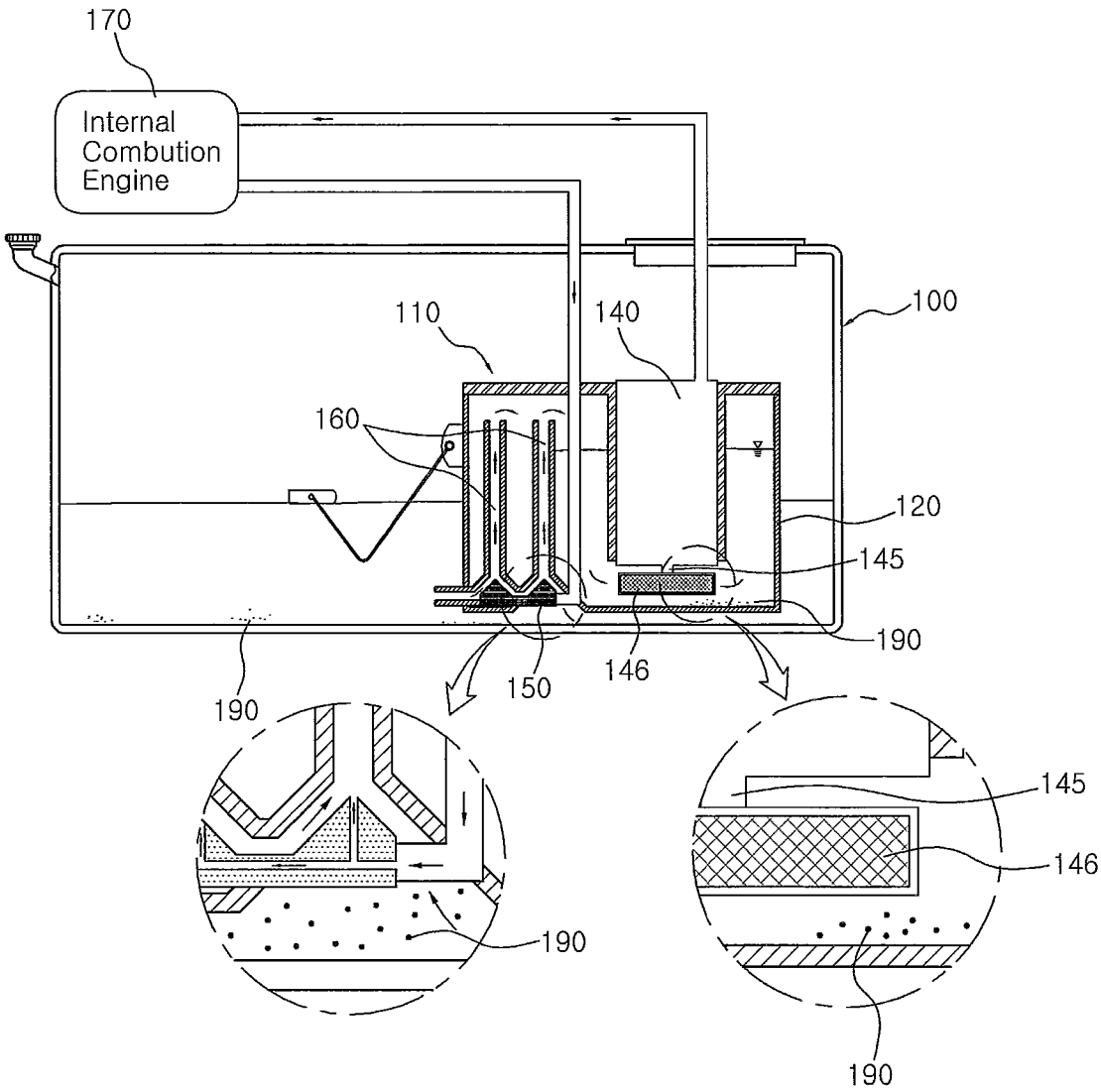
FIG. 1 is a sectional view illustrating a conventional A-type fuel pump module.
Figure 2:
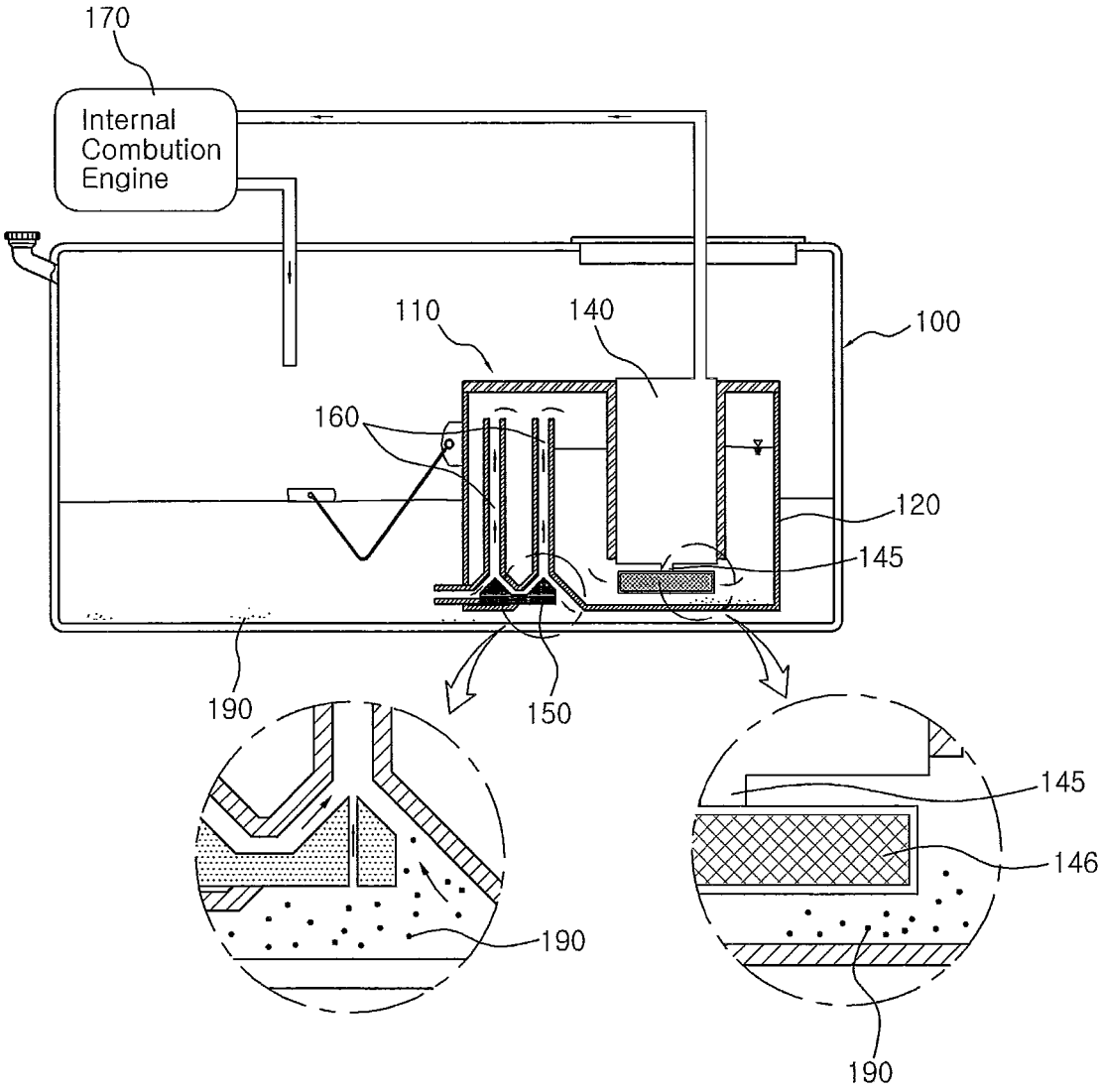
FIG. 2 is a sectional view illustrating a conventional B-type fuel pump module.
Figure 3:
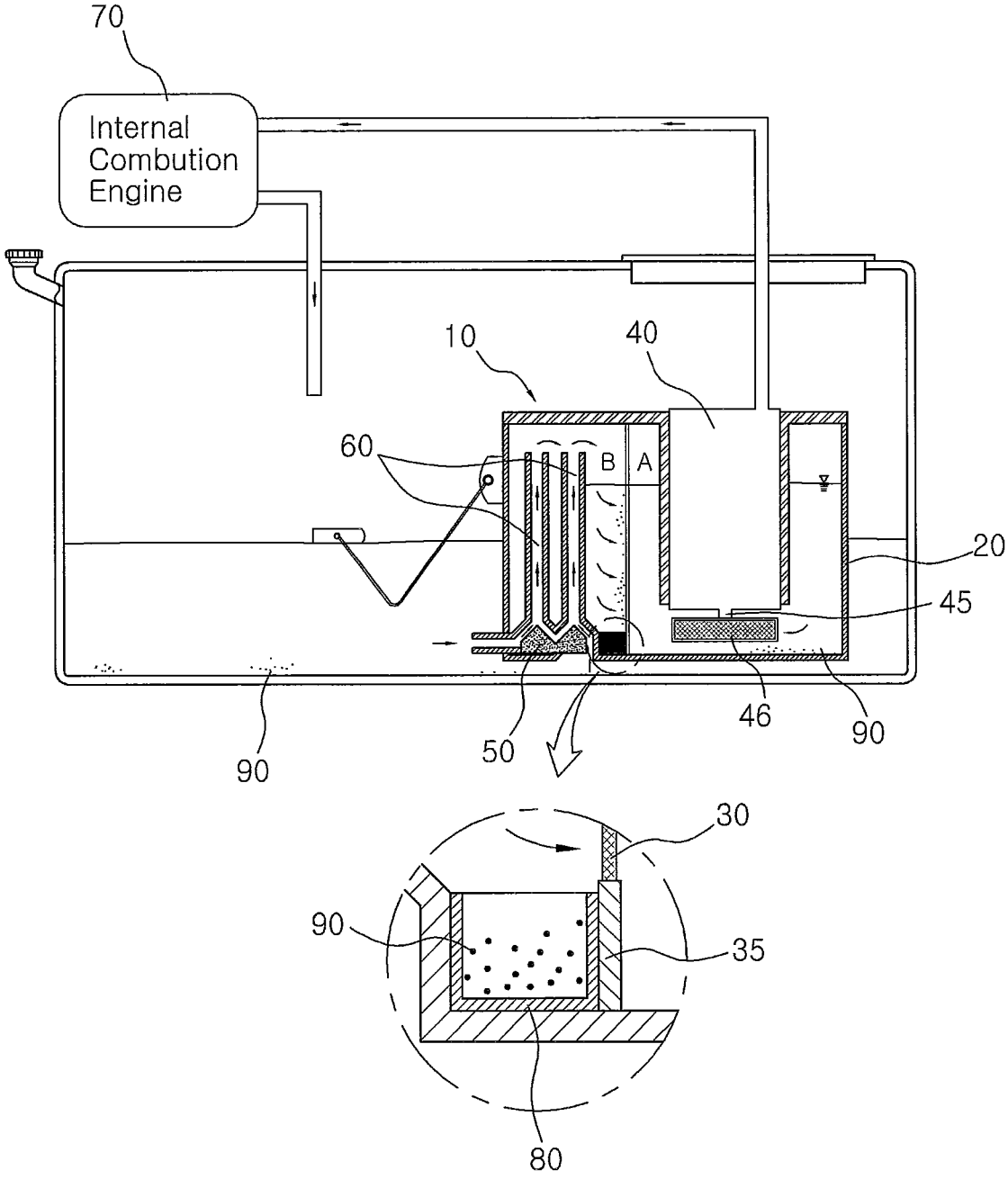
FIG. 3 is a sectional view illustrating a fuel pump module according to an embodiment of the present invention.
Figure 4:
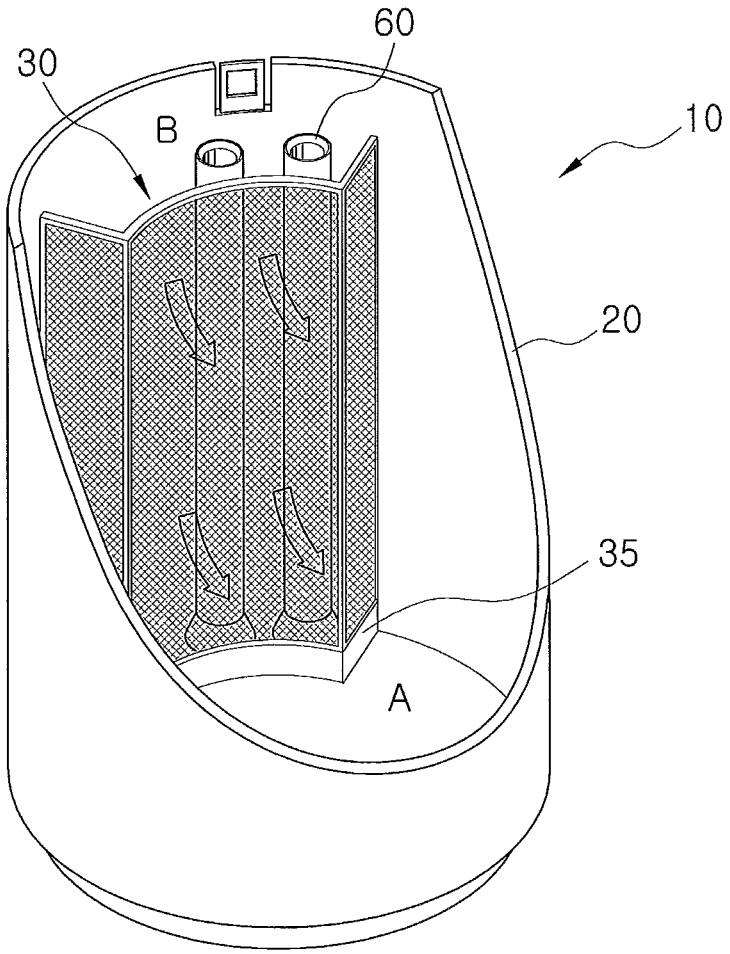
FIG. 4 is a partially broken perspective view illustrating the fuel pump module according to the present invention.
Figure 5:
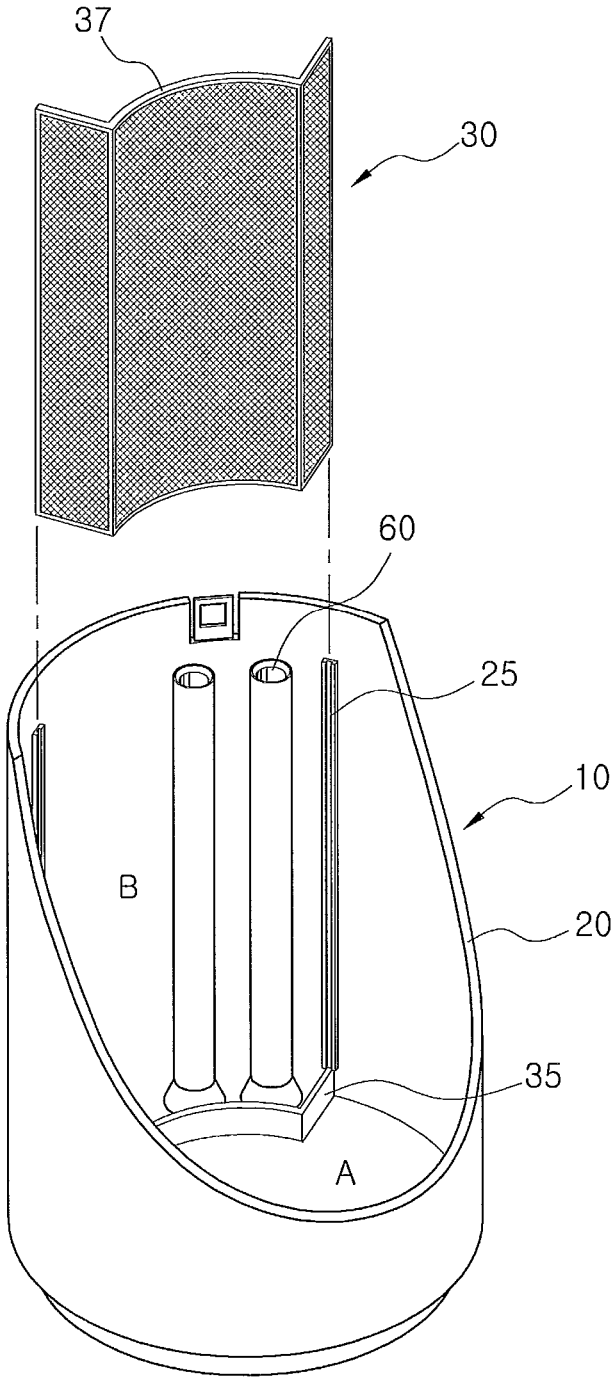
FIG. 5 is an exploded perspective view illustrating a fuel pump module according to another embodiment of the present invention.

FIG. 3 is a sectional view illustrating a fuel pump module according to an embodiment of the present invention. FIG. 4 is a partially broken perspective view illustrating the fuel pump module of the present invention. FIG. 5 is an exploded perspective view illustrating a fuel pump module according to another embodiment of the present invention.

As shown in FIG. 3, which is a sectional view illustrating the fuel pump module according to the present invention, the fuel pump module 10 according to the present invention includes: a reservoir 20 having a bowl shape capable of being charged with a predetermined amount of fuel; a fuel pump 40 installed in the reservoir 20 and pumping the fuel contained in the reservoir 20 to an internal combustion engine 70; a jet pump 50 naturally introducing the fuel stored in the fuel tank 100 into the reservoir 20; a guide tube 60 guiding the fuel introduced from the fuel tank 100 by the jet pump 50 to the reservoir 20 and preventing the fuel charged in the reservoir 20 from leaking out to the atmosphere; and a filter unit 30 placed between a fuel charging area B which introduces the fuel into the reservoir 20 using the guide tube 60 and a fuel suction area A, into which the fuel is introduced by the fuel pump 40, and separating the fuel suction area A from the fuel charging area B, so that foreign substances 90 present in the fuel as it flows from the fuel charging area B to the fuel suction area A can be filtered out and thereby clean fuel can be supplied to the internal combustion engine 70 when the fuel pump 40 is pumping fuel to the engine 70.

The reservoir 20 constituting the fuel pump module 10 functions to protect the fuel pump 40 installed in the reservoir 20 and to contain a predetermined amount of fuel therein, and has a container shape capable of storing the predetermined amount of fuel therein, as shown in FIGS. 4 and 5.

The reservoir 20 is always charged with the predetermined amount of fuel, so that, although when a vehicle is not level and thereby fuel filled in the fuel tank 100 leans to one side or when the vehicle is in a low-fuel state in which there is an insufficient amount of fuel charged in the fuel tank 100, the fuel can be supplied to the internal combustion engine 70 at a constant rate.

The fuel pump 40 installed in the reservoir 20 pumps the fuel contained in the reservoir 20 to the internal combustion engine 70. Specifically, the fuel pump 40 sucks the fuel through a fuel suction port 45 formed in a lower part inside the reservoir 20 and supplies the fuel to the internal combustion engine 70.

Here, in order to prevent the foreign substances 90 from damaging the fuel pump 40 during a process of sucking the fuel and to prevent the foreign substances 90 from causing problems in the internal combustion engine 70, the fuel suction port 45 is provided with a filter 46 for filtering foreign substances laid in the fuel passing through the fuel suction port 45.

The jet pump 50, which is installed in the reservoir 20 along with the fuel pump 40 and functions to guide the fuel stored in the fuel tank 100 into the reservoir 20 as described above, is installed on the bottom of the reservoir 20 in such a way that the jet pump 50 faces the inner surface of the top end of the reservoir 20.

The jet pump 50 installed on the bottom of the reservoir 20 may inject the fuel returning from the internal combustion engine 70 into the reservoir 20 at a high injection speed or may directly inject the fuel stored in the fuel tank 100 into the reservoir 20 at a high injection speed.

Because the fuel is injected into the reservoir 20 at a high injection speed by the jet pump 50, the flow velocity around the jet pump 50 increases, but pressure around the pump 50 is reduced, so that the fuel stored in the fuel tank 100 is naturally introduced to the jet pump 50 and that the fuel, after having been introduced into the jet pump 50, is guided into the reservoir 20. The fuel introduced to the jet pump 150 as described above flows into the reservoir 20 along with the fuel jet injected from the jet pump 50, thereby being charged into the reservoir 20.

In the present invention, in order to allow the fuel to be easily charged in the reservoir 20 even when the vehicle is not level and thereby the fuel filled in the fuel tank 100 leans to one side or when the vehicle is in a low-fuel state in which there is an insufficient amount of fuel charged in the fuel tank 100, it is preferred that the fuel pump module 10 including the jet pump 50 be installed at a location close to the bottom of the fuel tank 100.

The fuel introduced into the reservoir 120 by the jet pump 50 flows along the guide tube 60 installed on the jet pump 50 up to the height of the guide tube 60, and is charged in the reservoir 20.

The filter unit 30 provided in the reservoir 20 is configured such that the filter unit 30 can separate the fuel charging area B, in which the fuel passes through the guide tube 60 and is charged in the reservoir 20, from the fuel suction area A, into which the fuel is sucked by the fuel pump 40.

The filter unit 30 comprises a mesh and filters foreign substances 90 from the fuel flowing from the fuel charging area B to the fuel suction area A, so that only the clean fuel that is clean of foreign substances 90 can flow to the fuel suction area A and be fed to the internal combustion engine 70 by operation of the fuel pump 40.

Because the filter unit 30 comprising the mesh is provided in the reservoir 20, it is possible to filter the foreign substances out from the fuel introduced from the fuel tank 100 into the reservoir 20 and thereby to supply only the clean fuel that is clean of foreign substances to the internal combustion engine 70. Therefore, the fuel consumption ratio of the vehicle can be increased and both the fuel pump 40 and the internal combustion engine 70 can be protected from damage that the foreign substances may cause.

Here, the mesh size of the filter unit 30 is 55~65 microns, so that foreign substances having particle sizes larger than the mesh size can be filtered out by the filter unit 30.

FIG. 4 is a view illustrating the fuel pump module of the present invention. Hereinbelow, the fuel pump module of the present invention will be described with reference to FIG. 4.

Because the fuel pump module 10 including the jet pump 50 is installed at a location close to the bottom of the fuel tank 100, the foreign substances 90 present on the bottom of the fuel tank 100 are introduced into the reservoir 20 along with the fuel when the fuel stored the fuel tank 100 flows into the reservoir 20 along with the fuel jet injected by the jet pump 50.

The fuel having the foreign substances 90 is lifted upwards through the guide tube 60 and is introduced into the fuel charging area B inside the reservoir 20.

The fuel, which has been introduced into the fuel charging area B of the reservoir 20 as described above, is naturally forced to flow into the fuel suction area A by the fuel pumping operation of the fuel pump 40. In the above-mentioned process, part of the foreign substances 90 present in the fuel drop onto the bottom of the reservoir 20 due to gravity and the remaining part of the foreign substances are filtered out by the filter unit 30.

The foreign substances 90 filtered by the filter unit 30 drop onto the bottom due to gravity and only the clean fuel that is clean of foreign substances 90 can pass through the filter unit 30 and then flow into the fuel suction area A, into which the fuel is sucked by the fuel pump 40.

In the present invention, the filter unit 30 comprising the mesh is provided in the reservoir 20, so that foreign substances 90 can be filtered out from the fuel introduced from the fuel tank 100 and only the clean fuel can be supplied to the internal combustion engine 70 by the fuel pump 40.

The interior of the reservoir 20 is partitioned into the fuel charging area B for receiving the fuel from the fuel tank 100 and the fuel suction area A for sucking the fuel from the fuel charging area B by the fuel pump 40, with the filter unit 30 being integrally provided in the reservoir 20 for filtering out foreign substances 90 moving from the fuel charging area B to the fuel suction area A.

Further, the filter unit 30 is provided with a cutoff wall 35 at the lower end thereof. Due to the cutoff wall 35 provided at the lower end of the filter unit 30, it is possible to prevent the foreign substances 90, which have been filtered from the fuel by the filter unit 30 and dropped onto the bottom of the reservoir 20 due to gravity, from being sucked into the fuel as it flows from the fuel charging area B to the fuel suction area A and thereby from going back into the fuel. As seen in FIGS. 4 and 5, the cutoff wall 35 may be plate-shaped.

Further, a foreign substance collector 80 having a bowl shape is provided on the bottom of the fuel charging area B and collects therein the foreign substances 90 filtered by the filter unit 30.

Because the foreign substance collector 80 is provided on the bottom of the fuel charging area B for collecting the foreign substances, the foreign substances 90, which have been filtered by the filter unit 30 and have dropped onto the bottom of the reservoir 20, can be easily collected in the foreign substance collector 80.

Therefore, the present invention is advantageous in that the foreign substances 90 collected in the reservoir 20 can be easily removed by changing or washing the foreign substance collector 80.

Further, in order to easily remove the foreign substances collected in the foreign substance collector 80, it is preferred that the foreign substance collector 80 be detachably installed in the reservoir 20.

FIG. 5 is a view illustrating another embodiment of the present invention, in which guide grooves 25 are formed in the reservoir 20 and the filter unit 30 movably engages with the guide groove 25 in such a way that the filter unit 30 can be removably installed in the reservoir 20.

Because the filter unit 30 is configured to be separated from the reservoir 20 when necessary, it is easy to produce the reservoir 20 including the filter unit 30 and, when there occurs some problems in the filter unit 30, replace just the filter unit 30 with a new one, so that the time and cost for maintenance of the filter unit can be reduced.

A frame 37 having a predetermined thickness is provided along the edge of the filter unit 30 comprising the mesh. Due to the frame 37 having the predetermined thickness provided along the edge of the filter unit 30, the structural stability of the filter unit 30 increases and the filter unit 30 can be easily assembled or disassembled.

The fuel pump module of the present invention may use one filter unit 30 or at least two filter units 30.

The cutoff wall 35 is provided between the lower end of the filter unit 30 and the bottom of the reservoir 20. Due to the cutoff wall 35, it is possible to prevent the foreign substances 90, which have been filtered from out of the fuel by the filter unit 30 and dropped onto the bottom of the reservoir 20 due to gravity, from again being sucked into the fuel as it flows from the fuel charging area B to the fuel suction area A and thereby from going back into the fuel.

The cutoff wall 35 may be configured such that the cutoff wall 35 is integrated with the reservoir 20 and protrudes upwards, as shown in FIG. 3. Alternatively, the cutoff wall 35 may be integrated with the lower end of the filter unit 30.

The other constitution of the second embodiment remains the same as that of the first embodiment and further explanation is therefore not deemed necessary.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A fuel pump module comprising:

a reservoir installed in a fuel tank of a vehicle and having a bowl shape charged with a predetermined amount of fuel;

a fuel pump installed in the reservoir and pumping the fuel contained in the reservoir to an internal combustion engine;

a jet pump injecting a fuel jet into the reservoir and thereby introducing the fuel stored in the fuel tank into the reservoir;

a guide tube installed on the jet pump and extending upwards a predetermined distance, the guide tube guiding both the fuel jet injected by the jet pump and the fuel introduced from the fuel tank along with the fuel jet such that both the fuel jet and the fuel can be charged in the reservoir;

a filter unit partitioning an interior of the reservoir into a fuel suction area, into which the fuel is introduced by the fuel pump, and a fuel charging area, which is charged with the fuel from the fuel tank, the filter unit thus preventing foreign substances from being introduced from the fuel charging area into the fuel suction area; and a filter provided at a fuel suction port of the fuel pump to prevent the foreign substances passing through the filter unit from being introduced into the fuel pump, wherein the filter unit is provided with a plate-shaped cutoff wall at a lower end thereof.

2. The fuel pump module as set forth in claim 1, wherein the filter unit is integrated with the reservoir.

3. The fuel pump module as set forth in claim 1, wherein the filter unit is detachably installed in the reservoir.

4. The fuel pump module as set forth in claim 3, wherein the reservoir is provided with a guide groove on an inner surface thereof, and the filter unit is installed in the reservoir using the guide groove.

5. The fuel pump module as set forth in claim 1, wherein the cutoff wall integrally protrudes from the reservoir.

6. The fuel pump module as set forth in claim 1, wherein the cutoff wall is integrated with the lower end of the filter unit.

7. The fuel pump module as set forth in claim 1, wherein the fuel charging area is provided with a foreign substance collector on a bottom thereof.

8. The fuel pump module as set forth in claim 1, wherein the filter unit comprises mesh.

9. The fuel pump module as set forth in claim 8, wherein a mesh size of the mesh of the filter unit is 55~560 microns.

* * * * *

UNITED STATES PATENT AND TRADEMARK OFFICE

CERTIFICATE OF CORRECTION

PATENT NO. : 8,763,589 B2
APPLICATION NO. : 13/006971
DATED : July 1, 2014
INVENTOR(S) : Jong Keun Lim et al.

It is certified that error appears in the above-identified patent and that said Letters Patent is hereby corrected as shown below:

In the Claims

Column 8, Line 21, Claim 9, delete "55~560" and insert -- 55~60 --

Signed and Sealed this
Fourth Day of November, 2014

Michelle K. Lee

Michelle K. Lee
*Deputy Director of the United States Patent and Trademark Office*